US008291515B2

(12) United States Patent
Carter

(10) Patent No.: US 8,291,515 B2
(45) Date of Patent: Oct. 23, 2012

(54) SHIRT STAY FASTEN POINT DESIGNED SHIRT AND METHOD OF SECURING SAME

(76) Inventor: Scott Griffith Carter, Orange Park, FL (US)

( * ) Notice: Subject to any disclaimer, the term of this patent is extended or adjusted under 35 U.S.C. 154(b) by 184 days.

(21) Appl. No.: 12/590,061

(22) Filed: Nov. 2, 2009

(65) Prior Publication Data

US 2011/0099686 A1 May 5, 2011

(51) Int. Cl.
*A41B 1/00* (2006.01)

(52) U.S. Cl. ..... 2/117; 24/379.1; 24/302; 24/659

(58) Field of Classification Search ..... 2/75, 80, 2/111, 229, 230, 329, 335, 117, 119, 120, 2/248, 255; 450/111; 24/72.5, 379.1, 302, 24/659

See application file for complete search history.

(56) References Cited

U.S. PATENT DOCUMENTS

| | | | | | |
|---|---|---|---|---|---|
| 695,629 | A | * | 3/1902 | Shipley | 2/115 |
| 699,365 | A | * | 5/1902 | Block | 2/115 |
| 722,049 | A | * | 3/1903 | Saum | 2/332 |
| 723,560 | A | * | 3/1903 | Van Duyn | 2/332 |
| 1,035,053 | A | * | 8/1912 | Saltzman | 2/117 |
| 1,050,715 | A | * | 1/1913 | Bartell | 2/117 |
| 1,464,380 | A | * | 8/1923 | Agee | 24/471 |
| 1,570,492 | A | * | 1/1926 | Jackson | 2/313 |
| 1,685,091 | A | * | 9/1928 | Lifter | 450/29 |
| 1,803,214 | A | * | 4/1931 | Siegel | 24/698.3 |
| 1,840,793 | A | * | 1/1932 | Rose | 24/659 |
| 1,859,097 | A | | 5/1932 | Kayser | |
| 1,965,314 | A | * | 7/1934 | Henderson | 2/240 |
| 2,129,577 | A | * | 9/1938 | Guerin | 2/117 |
| 2,181,192 | A | * | 11/1939 | Liebmann | 2/117 |
| 2,508,049 | A | | 5/1950 | Tuck | |
| 2,604,626 | A | * | 7/1952 | King | 2/111 |
| 2,608,692 | A | | 9/1952 | Berg | |
| 3,002,193 | A | * | 10/1961 | Briskman | 2/72 |
| 3,470,878 | A | * | 10/1969 | Gottlieb | 450/95 |
| 5,001,782 | A | * | 3/1991 | Stewart | 2/69 |
| 5,177,813 | A | | 1/1993 | Bosack et al. | |
| 5,177,814 | A | | 1/1993 | Courtney | |
| 5,313,669 | A | | 5/1994 | Rasdell et al. | |
| 6,393,622 | B1 | * | 5/2002 | Rice | 2/406 |
| 2006/0010559 | A1 | | 1/2006 | Hamlet | |
| 2006/0048266 | A1 | | 3/2006 | Kim | |
| 2007/0067889 | A1 | | 3/2007 | Spiewak et al. | |

* cited by examiner

*Primary Examiner* — Khoa Huynh
*Assistant Examiner* — Anna Kinsaul
(74) *Attorney, Agent, or Firm* — Nields, Lemack & Frame, LLC

(57) ABSTRACT

A garment such as a shirt, blouse, jersey, vest or jacket, having a plurality of fastening points for attachment of a shirt stay, shirt holder or other retaining harness therethrough. The fastening points ensure that the garment remains tucked in to promote a uniform, neat appearance. Also disclosed is a method of retaining a garment in proper orientation on a wearer by providing a plurality of fastening points in the garment, at least some of which are preferably in pairs, such that each fastening point within a pair can be aligned with the other of the pair, and the pair can cooperatively receive a fastening mechanism therethrough to anchor the garment in place. The fastening points are positioned so that when one or more shirt stays, holders, harnesses or the like are properly engaged in the fastening points, a desired appearance of the garment being worn is created and maintained.

10 Claims, 2 Drawing Sheets

SHIRT STAY FASTEN POINT DESIGNED SHIRT AND METHOD OF SECURING SAME

BACKGROUND

Shirt stay devices are well-known, particularly for the pervasive use within the military services. They provide a method to promote the appearance of a squarely tucked and fitted wrinkle free shirt from both front and back views. These devices generally are used to constantly avoid tucking and re-tucking one's shirt into one's pants. Indeed, military appearance is a characteristic trait that is observed, graded and considered during promotion reviews in all services. Accordingly, use of shirt stays to enhance one's appearance is common.

Several different styles of shirt stays are commercially available. For example, individual four strand and stirrup styles are readily available as accessories sold at military exchanges, outposts or retail facilities where the required uniforms are also available for purchase. The clip ends of these accessories consist of a rubber male lead and female wire receptacle clevis which are designed to fasten together while grasping, clamping and securing a piece of the garment in place between the fasteners. The opposite or lower end of these devices is normally either fastened or secured to the upper region of the wearer's socks, or around the bottom of the heel if they are of the stirrup style. An adjustable clamp is often provided in order to lengthen or shorten the elongated flexible strap to fit the user. However, the clip and clevis attachment method is generally inadequate for firm and prolonged attachment; the upper garment clip ends often become loose or more often, unattached, particularly during moderate or excessive activity of the wearer.

It therefore would be desirable to provide a garment fastening mechanism and method that allows conventional shirt stay or shirt holder devices to fasten together without grasping and gathering garment material and using it as the mooring matter.

It further would be desirable to provide a garment with strategically placed fastening points in order to promote a square, symmetrical and wrinkle-free appearance of a tucked-in garment.

SUMMARY

The problems of the prior art have been overcome by the embodiments disclosed herein, which provide a mechanism and method for neatly affixing a garment on a wearer, such as in a tucked-in position within the waistband, and a garment configured to carry out the method. In certain embodiments, the garment is a garment that is worn on the upper torso, such as a shirt, blouse, jersey, vest or jacket, which is desired to be tucked into another garment worn on the lower torso, such as pants, shorts, skirts, kilts, knickers or trousers, particularly so that the garments are arranged properly, neatly and/or conventionally with respect to each other while being worn. In certain embodiments, the garment has a plurality of fastening points, which enable the attachment of a shirt stay, shirt holder or other garment retaining harness therethrough. In certain embodiments, the fastening points are perforations or apertures provided in the garment. In certain embodiments, the fastening points are perforations or apertures positioned on opposite sides of a crease in the garment. In certain embodiments, the garment is a shirt having shirt tails, and the apertures are located in the shirt tails. In certain embodiments, the perforations or apertures are reinforced about their perimeters.

In its method aspects, embodiments disclosed herein include a method of retaining a garment in proper orientation on a wearer by providing a plurality of fastening points in the garment, at least some of which are preferably in pairs, such that each fastening point within a pair can be aligned with the other fastening point within that pair, and the pair can cooperatively receive a fastening mechanism therethrough to anchor the garment in place. Non-paired fastening points similarly function to receive a fastening mechanism therethrough to anchor the garment in place. The fastening points are strategically positioned so that when one or more shirt stays, holders, harnesses or the like are properly engaged in the fastening points, a desired appearance of the garment being worn is created and maintained on the wearer. The fastening points are preferably perforations or apertures formed in the garment.

DETAILED DESCRIPTION

Figure 1:
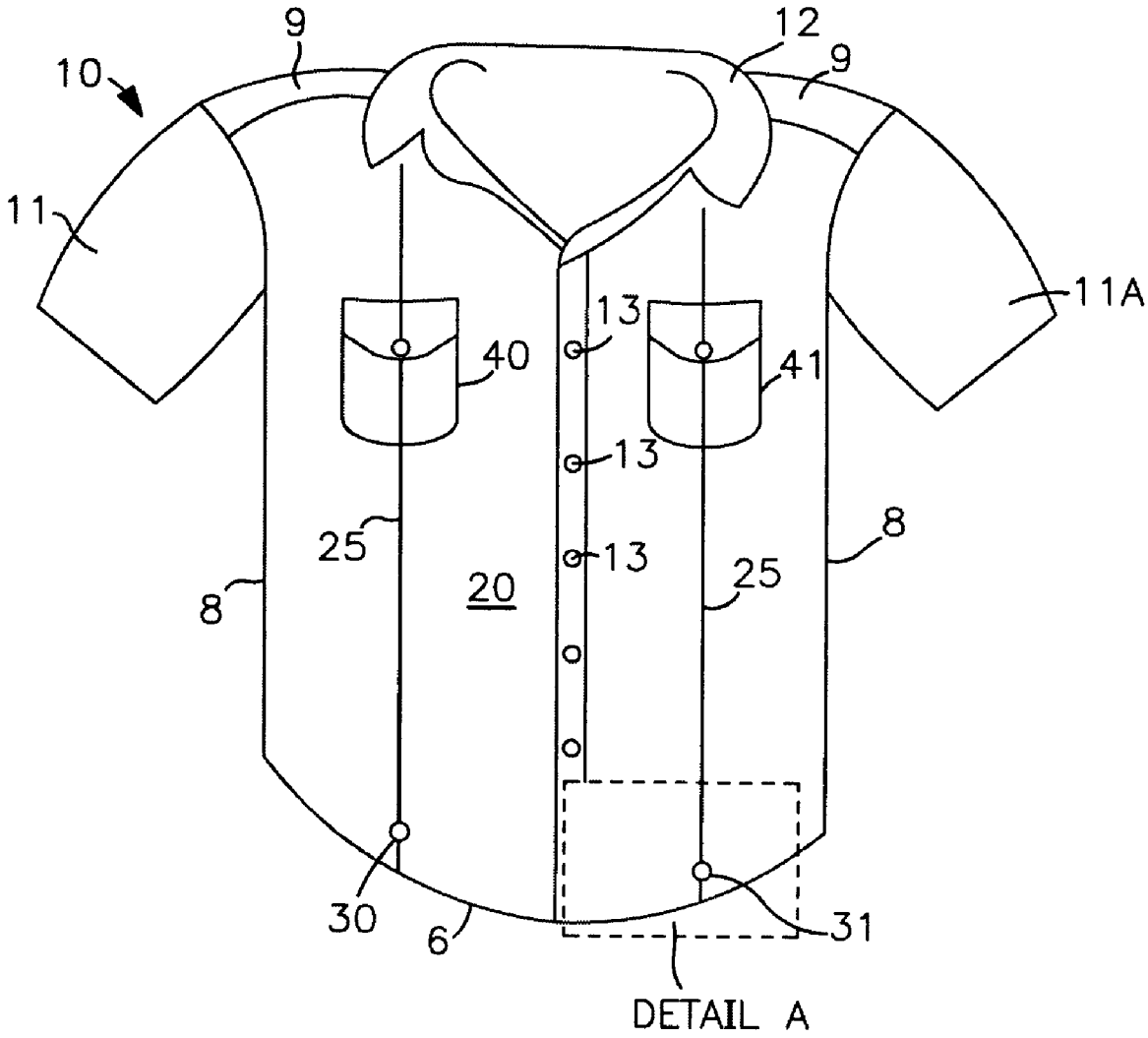
FIG. 1 is a front view of a garment in accordance with certain embodiments.
Figure 2:
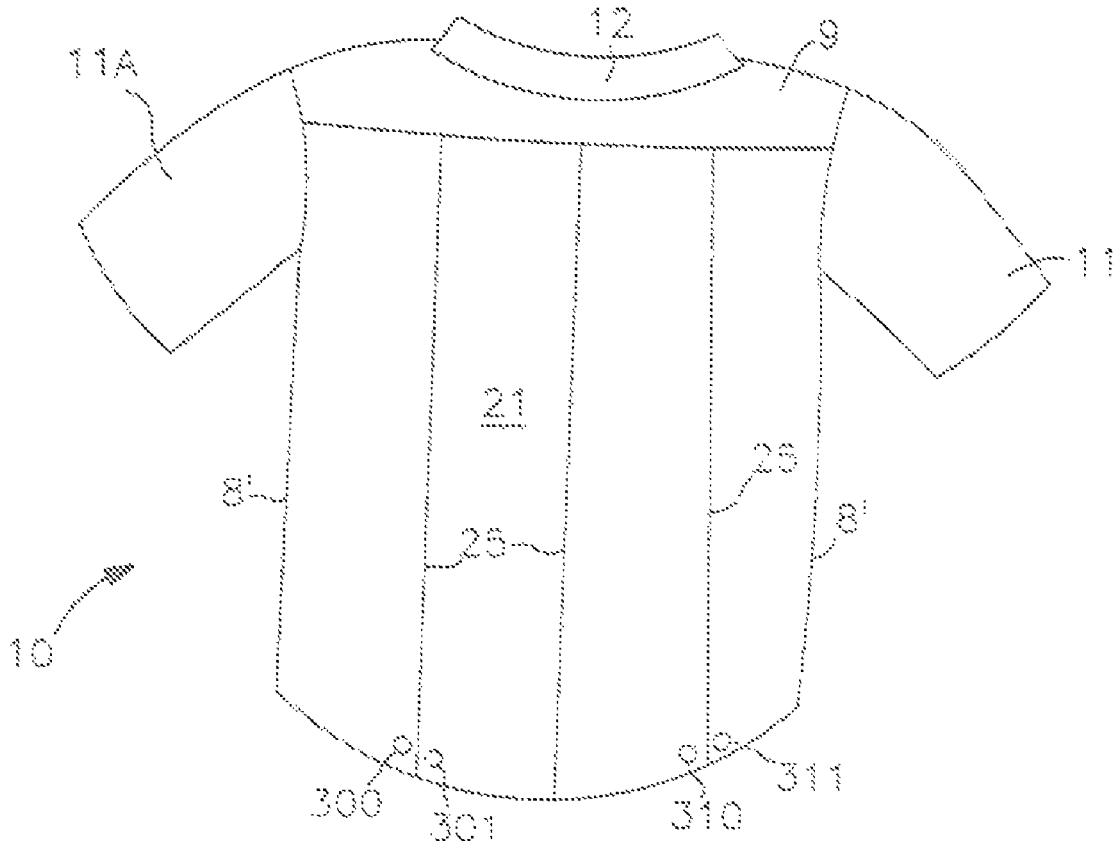
FIG. 2 is a rear view of a garment in accordance with certain embodiments.

Turning first to FIGS. 1 and 2, there is shown a garment 10, which in the embodiment shown, is a short sleeve shirt. Those skilled in the art will appreciate that the particular type, size, style and configuration of garment shown is for illustrative purposes only, and the embodiments disclosed herein are not limited thereto.

In the embodiment shown, the garment 10 is configured to be worn on the upper torso of a person and may include a front panel 20, a rear panel 21, side panels (not shown) connecting the front and rear panels, optional opposite sleeves 11, 11A extending generally radially from the upper or shoulder portions of the front and rear panels, and an optional collar 12 positioned on the upper portions of the front and rear panels and generally between the sleeves. The side panels can be eliminated, so that the front and real panels are joined directly. One or more buttons 13, zippers or other fastening mechanism optionally can be provided to secure the garment 10 on the wearer. Alternatively, the garment can be a continuous unitary structure that is pulled over the head and thus requires no fastening mechanism to secure it on the wearer. The lower portion of the front and/or rear panel can terminate in shirt-tails, or portions which generally extend longitudinally lower than the side panels or other portions of the garment. The various front, rear and side panels can be a single integral piece of fabric or can be attached such as by sewing. One or more longitudinal pleats or crease lines 25 can be formed in the garment 10. The garment 10 can be made of any suitable material typically used for clothing, including cloth, polyester, nylon, wool, cotton and combinations thereof.

Figure 4:
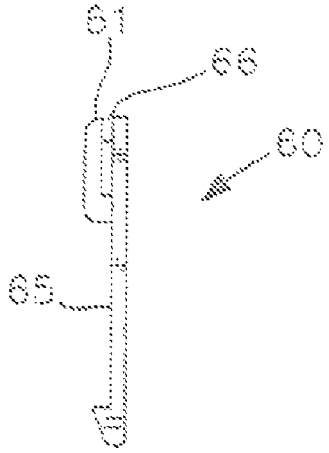
FIG. 4 is a side view of a portion of the fastening device of FIG. 3.
Figure 3:
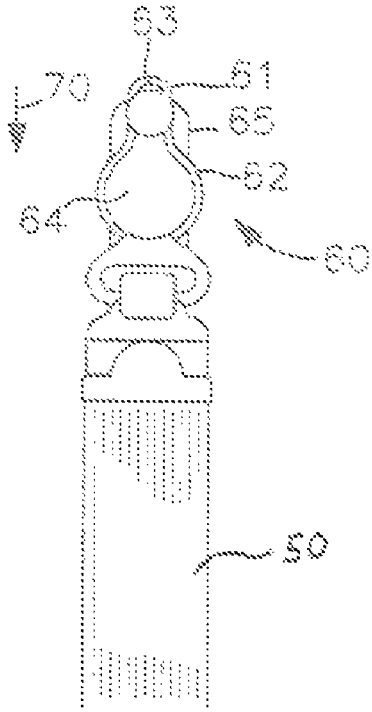
FIG. 3 is a top view of a fastening member of a conventional shirt stay device.

Conventionally, such garments or the like have been held in a tucked-in relation with a garment worn on the lower torso by various shirt retaining devices, such as stays, holders or harnesses. Such retaining devices typically include elongated straps 50, which can be elastic, that have connecting members at or near their respective ends. At least some of these connecting members fasten together, sandwiching the upper garment in between. The opposite or distal ends of the elongated straps secure elsewhere on the wearer, such as to the wearer's foot or socks, thereby biasing the upper garment to its tucked-in position. As shown in FIG. 3, the garment connecting members 60 generally include an male portion 61 such as a button, a disc-shaped member or the like extending axially from a preferably flexible substrate 65, that functions as a latching member, and is configured to be received by a female portion 62, such as a clip having an eyelet configured to removably receive the male portion 61 in locking engagement, such as the connecting members disclosed in U.S. Pat. No. 5,313,669, the disclosure of which is hereby incorporated by reference. Thus, the female portion 62 has a portion 64 having an internal diameter greater than the largest outer diameter of the male portion 61, and a portion 63 (e.g., the eyelet) having an internal diameter smaller than the largest outer diameter of the male portion 61. The male portion 61 includes a slot or groove 66 formed under the top surface thereof (FIG. 4), configured to receive the upper rim of the female portion 62. The substrate (and thus the male portion 62) is movable (such as by a pivot motion) with respect to the female portion 62, thereby allowing a garment to be inserted between the two and then subsequently clamped or secured by causing the female portion and male portion to move towards one another and engage with one another.

Figure 1A:
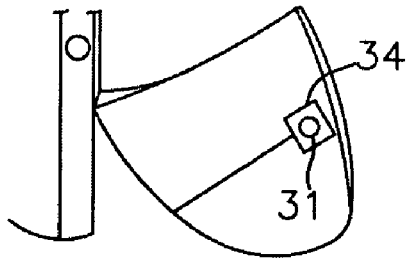
FIG. 1A is an enlarged detail of the back side of a portion of the garment of FIG. 1 in accordance with certain embodiments.

In accordance with certain embodiments, the lower portion or shirttail portion of the front panel 20 includes at least two spaced front panel fastening points 30, 31. Preferably each front panel fastening point is located about the same distance from its respective side panel or the longitudinal edges 8 of the front panel 20. In embodiments where the garment 10 has symmetrical longitudinal pleats or crease lines 25 (as in the embodiment shown in FIG. 1), preferably each front panel fastening point is located at or near a respective pleat or crease line 25, most preferably bisecting the same. Where the garment 10 includes symmetrical spaced pockets 40, 41, the fastening points 30, 31 can be along the respective longitudinal center line of those pockets. In certain embodiments, the fastening points are perforations or apertures provided in the garment 10, which can be irregularly or regularly shaped. Regularly shaped apertures are preferred, such as square, rectangular, triangular, and most preferably circular apertures. Preferably the shape of the apertures is configured to receive the male portion of the fastening member, and thus matches the shape of the male portion of the fastening member. The size of the apertures should be sufficient to effectively receive therethrough the male portion of a fastening member in a shirt stay, holder or harness device. For example, where the male portion has a circular cross section, preferably the aperture also has a circular cross section, and has a diameter about the same as or slightly greater than (e.g., about 0-10% greater than) the largest diameter of the male portion of a fastening member. One suitable aperture is a circular aperture having a ⅜ inch diameter. Preferably the edges of the apertures are reinforced, such as by embroidering, embossing, or edging with grommet material such as metal the perimeter of the aperture, and/or by attaching a fasten point support material 34 about the periphery of the aperture, such as by sewing, gluing or ironing on (e.g., by using a heat activated adhesive) fabric to the garment 10 about the aperture (FIG. 1A). One suitable fastening point support material 34 is adhesive-backed cloth. One or both sides of the apertures (e.g., the front or outwardly facing side of the front panel 20 and the rear or inwardly facing side of the front panel 20) may be reinforced. By reinforcing the apertures, undesirable tearing of the garment caused by the force of the shirt stay device or the like is minimized or eliminated. In addition, reinforcing the apertures provides a more rigid area around the apertures, which facilitates attachment of the shirt stay, holder or harness connectors through the apertures.

Each front panel fastening point 30, 31 is preferably positioned just above the bottom edge 6 of the garment 10, where it is not visible when the garment is being worn. For example, the center of each fastening points 30, 31 can be about ¼ to about 1 inch above the bottom edge, most preferably about ¾ inches above the bottom edge. Preferably they are horizontally aligned, e.g., a horizontal line can be drawn through their centers.

Any suitable means can be used to form the fastening points in the garment 10, such as punching, cutting, tearing, etc., either manually or automatically, or the garment could originally by fabricated having such fastening points.

In accordance with certain embodiments, the lower portion or shirttail portion of the rear panel 21 includes at least two spaced front panel fastening points, preferably four fastening points 300, 301, 310, 311. Preferably fastening point 300 and fastening point 311 are located about the same distance from their respective side panels or garment edges 8'. Similarly, preferably fastening points 301 and 310 are located about the same distance from their respective side panels or garment edges 8'. Where the rear panel of garment 10 has symmetrical pleats or crease lines 25 (as in the embodiment shown in FIG. 2), preferably each rear panel fastening point is located at or near a respective pleat or crease line 25. For example, an outer edge of each fastening point may be spaced about inches from the pleat or crease line 25 at its closest point. In the embodiment shown, four fastening points are provided in the rear panel 21, preferably in spaced pairs, with a crease line 25 bisecting the two fastening points within each pair as shown in FIG. 2. As will become apparent below, so locating the fastening points helps ensure that the crease lines 25 remain vertically oriented while the garment 10 is being worn, and provide a tapered fit. Such a paired arrangement also can be used even if no crease lines 25 are present in the garment. In certain embodiments, as is the case with the fastening points in the front panel, the rear panel fastening points are perforations or apertures, which can be irregularly or regularly shaped. Regularly shaped apertures are preferred, such as square, rectangular, triangular, and most preferably circular apertures. Preferably the shape of the apertures is configured to receive the male portion of the fastening member, and thus matches the shape of the male portion of the fastening member. The size of the apertures should be sufficient to effectively receive therethrough the male portion of a fastening member in a shirt stay, holder or harness device. For example, where the male portion has a circular cross section, preferably the aperture also has a circular cross section, and has a diameter about the same as or slightly greater than (e.g., about 0-10% greater than) the largest diameter of the male portion. One suitable aperture is a circular aperture having a ⅜ inch diameter. Preferably the edges of the apertures are reinforced, such as by embroidering, embossing, or edging with grommet material such as metal the perimeter of the aperture, and/or by attaching a fasten point support material 34 about the periphery of the aperture, such as by sewing, gluing or ironing on fabric to the garment 10 about the aperture (FIG. 1A). One suitable fastening point support material 34 is adhesive-backed cloth. One or both sides of the apertures (e.g., the front or outwardly facing side of the rear panel 21 and the rear or inwardly facing side of the rear panel 21) may be reinforced. By reinforcing the apertures, undesirable tearing of the garment caused by the force of the shirt stay device is minimized or eliminated. In addition, reinforcing the apertures provides a more rigid area around the apertures, which facilitates attachment of the shirt stay, holder or harness connectors through the apertures.

Each rear panel fastening point 300, 301, 310, 311 is preferably positioned just above the bottom edge 6 of the garment 10, where it is not visible when the garment is being worn. For example, the center of each fastening point can be about ¼ to about 1 inch above the bottom edge, most preferably about ¾ inches above the bottom edge. They are horizontally aligned, e.g., a horizontal line can be drawn through their centers.

Those skilled in the art will appreciate that where no crease lines or pleats are visible or desired in the rear panel, paired fastening points are not necessary; two spaced single fastening points can be used as is the case with the front panel 20. Alternatively, even if no permanent crease lines or pleats are present, by using paired fastening points, a tapered fit still can be created.

The plurality of fastening points facilitates the fastening of the garment 10 to the shirt stays, holders, harnesses and the like. They also reduce or eliminate the tendency of the garment to become unfastened, particularly when the wearer is engaged in activities that require significant bodily movements, such as exercise, jogging, running, etc., that place varied and/or excessive forces on the garment holder. Since the fastening points allow the shirt stay, holder or harness connecting member to pass through the garment, rather than sandwich the garment as in the prior art, a stronger fastening engagement is achieved.

In embodiments where the fastening points are provided in spaced pairs, such as that shown in FIG. 2, attachment of the garment holder is accomplished by folding the garment 10 in the vicinity of the paired fastening points such that the fastening points overlap or substantially overlap each other in an amount sufficient to receive therethrough the male portion of the fastening mechanism. For example, the lower 1-2 inches of the rear panel 21 of the garment 10 can be folded on the crease 25 such that fastening points 300 and 301 overlap. Even where no permanent creases or pleats are provided, this folding of the rear panel can create the appearance of such lines. The male portion of the fastening device is then guided through the overlapping apertures, and is engaged with the female portion of the fastening device, thereby securing the garment 10.

In operation, the garment can be retained in a proper or desired orientation on a wearer as follows. The fastening devices on a shirt stay, holder, harness or the like are attached to the various fastening points, either prior to or after the wearer dons the garment. For example, the male portion 61 of a shirt stay fastening mechanism is moved away from the female portion and is guided through fastening point 30, such as from the rear or underside of the garment 10, until it protrudes through the aperture 30 a sufficient distance to enable it to be engaged by the female portion 62. It is then inserted into the larger diameter portion 64 of the female portion, and the female portion is then moved radially in the direction of arrow 70 in FIG. 3 until the male portion is forced into the smaller diameter portion 63, whereupon the upper rim of the female portion snaps into or otherwise engages the slot 66, locking the male portion in place. The garment 10 is now secured to the shirt stay through the fastening point 30, between the substrate 65 and the female portion 62. The same operation is performed with the fastening point 31.

A similar operation is also performed with the fastening points in the rear panel 21, except that where the fastening points are provided in pairs, a portion of the garment (e.g., the lower 1-2 inches of the garment in the vicinity of the paired fastening points) is folded such that each fastening point within a pair is substantially aligned with or overlapped with the other fastening point within a pair prior to guiding the male portion through. The opposite ends of the shirt stays, holders or harnesses are then secured as is conventional, such as by attachment to a respective sock or foot of the wearer at a location where sufficient tension is provided to bias the garment 10 to it proper position on the wearer.

What is claimed is:

1. A garment assembly, comprising a material adapted to be worn on the upper torso of a person, said material including a lower portion adapted to be tucked into a second garment worn on the lower torso of said person; said lower portion having a plurality of fastening points comprising apertures in said garment, and a shirt stay comprising an elongated biasing member and a fastening member, said fastening member having a substrate, a male member portion extending from said substrate, and a female member; wherein at least some of said apertures are positioned in opposing spaced pairs, wherein the spacing between opposing pairs allows for a fold of said material designed to form a longitudinal crease line bisecting the opposing pair to cause each of said apertures within an opposing pair to align and receive said male member portion which extends through said aligned pair and is engaged by said female member to secure said garment against said substrate and bias said garment to maintain it in said tucked in condition.

2. The garment of claim 1, wherein each of said plurality of apertures is circular.

3. The garment of claim 1, wherein each of said apertures has a perimeter, and wherein each said perimeter is reinforced.

4. The garment of claim 1, wherein said material is cloth.

5. The garment of claim 1, wherein there are six fastening points.

6. A method of securing a garment in a tucked in position on a person, comprising providing a plurality of fastening points in said garment, at least some of which are arranged in opposed spaced pairs, each opposed spaced pair having a first and second fastening point, aligning said first and second fastening point of an opposed spaced pair to create an aligned pair of fastening points, providing a plurality of shirt stays, each comprising an elongated member and a fastening mechanism comprising a male portion extending from a substrate and a spaced female portion movable with respect thereto; guiding each said male portion through a respective aligned pair of fastening points designed to form a longitudinal crease line bisecting the pair of aligned fastening points within the garment; engaging each said male portion with a respective female portion thereby securing said garment between said substrate and said female portion; attaching each said shirt stay to said wearer at a location that biases said garment in said tucked in position; and tucking said garment in with respect to a second garment worn by said person.

7. The method of claim 6, wherein said fastening points are apertures.

8. A garment and shirt stay assembly, said garment comprising a material adapted to be worn on the upper torso of a person, said material including a lower portion adapted to be tucked into a second garment worn on the lower torso of said person; said lower portion having a plurality of fastening points comprising apertures in said garment, said garment being folded along a longitudinal crease line bisecting a pair of apertures such that at least one of said apertures of the pair of apertures aligns with another of said apertures of the pair of apertures, and a shirt stay comprising an elongated strap and a fastening mechanism, said shirt stay attached to said garment with said fastening mechanism through said aligned apertures to bias said garment and maintain it in said tucked in condition.

9. The assembly of claim 8, wherein each of said plurality of apertures is circular.

10. The assembly of claim 8, wherein each of said apertures has a perimeter, and wherein each said perimeter is reinforced.

* * * * *